US006960732B1

(12) United States Patent
Spiegel et al.

(10) Patent No.: US 6,960,732 B1
(45) Date of Patent: Nov. 1, 2005

(54) ELECTRIC SWITCH INSERTABLE INTO A CONTROL/DISPLAY SCREEN

(75) Inventors: Edgar Spiegel, Homburg (DE); Thomas Prowald, Dirmingen (DE); Martin Fickert, Herrstein (DE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/352,498

(22) Filed: Jan. 28, 2003

(30) Foreign Application Priority Data

Jan. 30, 2002 (DE) ..... 102 03 510

(51) Int. Cl.[7] ..... H01H 1/64
(52) U.S. Cl. ..... 200/296; 200/293
(58) Field of Search ..... 200/293–296, 200/341, 345, 520, 573

(56) References Cited

U.S. PATENT DOCUMENTS 3,805,004 A * 4/1974 Kondo et al. ..... 200/311
4,220,808 A * 9/1980 Fujita ..... 174/48
4,354,078 A * 10/1982 Yoshimura ..... 200/314
5,077,454 A * 12/1991 Lorenzo ..... 200/573
6,121,564 A * 9/2000 Huang ..... 200/345
6,459,058 B1 * 10/2002 Shinohe et al. ..... 200/341
6,667,447 B2 * 12/2003 Liu et al. ..... 200/5 R

* cited by examiner

*Primary Examiner*—Elvin Enad
*Assistant Examiner*—Lisa Klaus
(74) *Attorney, Agent, or Firm*—Robert O. Rice; Stephen Krefman; John F. Colligan

(57) ABSTRACT

The invention concerns an electric switch with an activation element that is inserted and retained with limited axial adjustability in a pot-shaped receptacle formed on a control/display screen and that can be connected to a control component of a switch part. The invention provides that two snap springs are separated on the perimeter of the activation element that protrude over the peripheral contour of the activation element with snap flanges, that the snap springs can be snapped into snap notches of the pot-shaped receptacle and have limited axial adjustability, that the receptacle provides a receiving cavity for the switch part, which is introducible perpendicular to axial direction and localizable in the receptacle, and that when inserting the switch part into the receiving cavity, the control component of the switch part is introducible with a catch into a catch receptacle of the activation element and subsequently connectable with the activation element.

8 Claims, 5 Drawing Sheets

ELECTRIC SWITCH INSERTABLE INTO A CONTROL/DISPLAY SCREEN

BACKGROUND OF THE INVENTION

1. Field of the Invention

The invention concerns an electric switch with an activation element that is inserted and retained with limited axial adjustability in a pot-shaped receptacle formed on a control/display screen and that can be connected to a control component of a switch part that can be set to two positions by means of the activation element.

2. Description of the Related Art

Electric switches are being incorporated into control/display screens more and more, particularly when it comes to household appliances. Such electric switches do not come as pre-installed control components, but are incorporated into the control/display screen as a switch housing, as disclosed in EP 0 423 924 A1, for example. The benefit is that several electric switches can be incorporated into the control/display screen that may also demonstrate a variety of switching characteristics.

In doing so the electric switches are used to transfer control signals to a corresponding electric device control.

The task of the invention is to simplify an electric switch of the type mentioned at the outset in terms of complexity of parts and assemblage and subsequently to provide a design that allows it to be easily adaptable to a variety of switching characteristics.

SUMMARY OF THE INVENTION

According to the invention this task is solved in that two axially-aligned snap springs are separated on the perimeter of the cap-shaped activation element that protrude over the peripheral contour of the activation element with snap flanges, that the snap springs can be snapped into axially-aligned snap notches of the pot-shaped receptacle on the control/display screen and have limited axial adjustability, that the receptacle provides a receiving cavity for the switch part, into which the switch part is introducible perpendicular to axial direction and localizable in the receptacle, and that when inserting the switch part into the receiving cavity, the control component of the switch part is introducible with a catch into a catch receptacle of the activation element and subsequently connectable with the activation element.

Using this design and connecting the activation element with the receptacle on the control/display screen easily accomplishes that the activation element is retained just by snapping it into the receptacle of the control/display screen adjustable, wherein the axially-limited adjustability predetermines the feed path for the activation element and the control component of the switch part. Additionally, any great force exerted on the activation element is kept away from the control component and the switch part and intercepted by the receptacle of the control/display screen. The switching component with the control component is inserted and hitched perpendicular to the activation direction of the activation element into a transversely aligned receiving cavity of the receptacle of the control/display screen. The control/display screen can be manufactured with a simple, slide-less mould.

A catch of the control component is thereby inserted into and connected with a snap receptacle of the activation element such that the adjustment movement of the activation element is transferred onto the actuator of the switch part. Actuator and switch part form monostable or bistable switches with switching components (contact banks) depending on the desired switching characteristic. This way the electric switch can easily be adapted to various requirements. For installation, the activation element and receptacle of the control/display screen are just plugged into each other and snapped together. The same holds true for the switching component with the control component and the receptacle of the control/display screen such that the electric switch can be assembled without additional fastening elements and incorporated into the control/display screen.

The design of the button and the switch panel fully conceals the snap/fastening element, taking aesthetic requirements of the control screen/switch panel into consideration.

If a design specifies that the receptacle of the control/display screen is at least partially closed and serves as a stop limit for the axial adjustment of the activation element in the receptacle and that the exposed face of the activation element constitutes the counter stop, then the receptacle of the control/display screen limits the axial adjustment movement in the direction of the switch part with the exposed face of the activation element. The receptacle intercepts intensified adjustment forces and isolates them from the control component of the switch part.

In order to prevent the axial adjustment forces exerted on the control component from causing the snap connection between the switch part and the receptacle of the control/display screen from releasing, the switch part is inserted perpendicular to the adjustment direction of the activation element into the receiving cavity of the receptacle and snapped in and consequently assumes a defined connect position in the receptacle.

The adjustment range of the activation element in the receptacle of the control/display screen is clearly defined in that the snap notches of the receptacle define the axial adjustment range of the activation element in the receptacle and subsequently the feed path of the control component of the switch part connected with the activation element.

Since the switch part can be designed either as a monostable or bistable switching component, the switching characteristics of the electric switch are varied only by implementing a switching component of one the two types. In doing so the switch part is able to form a receptacle for the switching component with the control component, which is connectable with the control component of the same when inserted into the switch part. In addition, the switching component may also have a different contact bank.

Different switching components can be inserted arbitrarily into the switch part and connected with its control component, allowing other variations to exist for the electric switch, without having to change the activation element, the receptacle of the control/display screen and the switch part with control component designed as a receptacle for a separate switching component.

In a preferred embodiment the activation element and the receptacle of the control/display screen are essentially round in shape. Both these parts are each designed as a one-piece plastic injection mould and can be manufactured cost-efficiently using simple injection mould dies.

BRIEF DESCRIPTION OF THE DRAWINGS

The invention is explained in more detail using an example embodiment shown in the drawing. It shows FIGS. 1 and 2 arranged assembled, the parts of an electric switch for incorporation into a control/display screen as viewed from the backside of the control/display screen.

DETAILED DESCRIPTION

Figure 2:
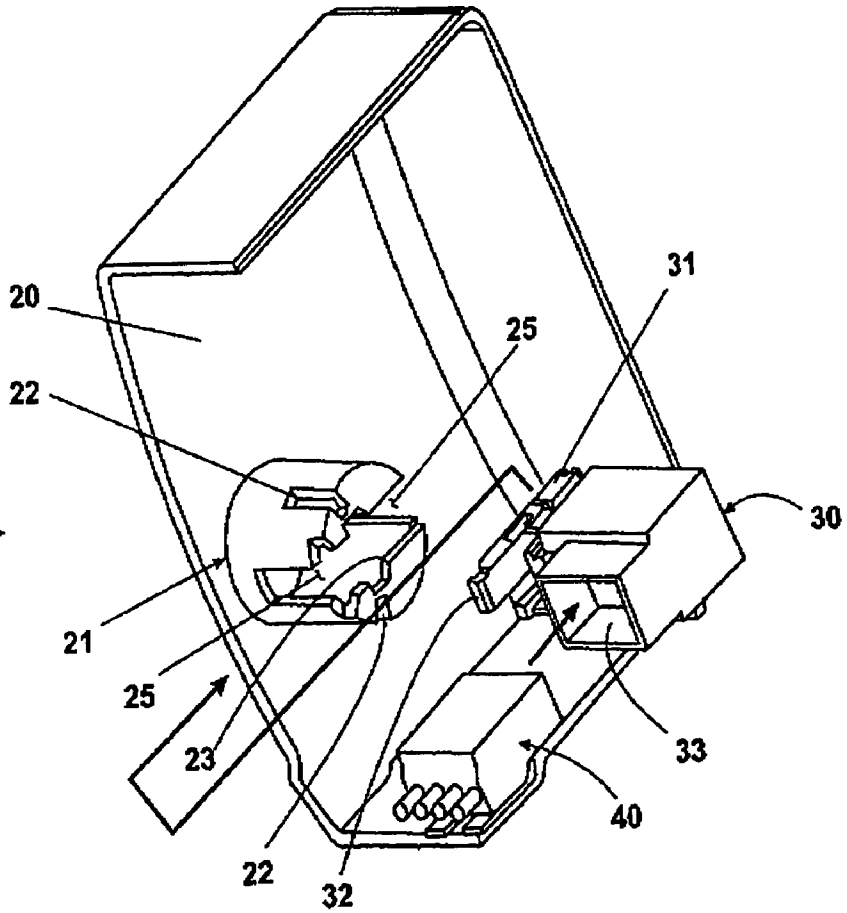
Figure 1:
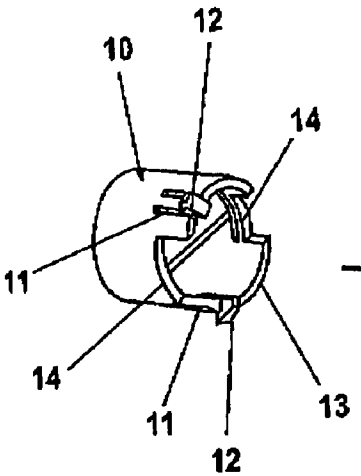
Figure 3:
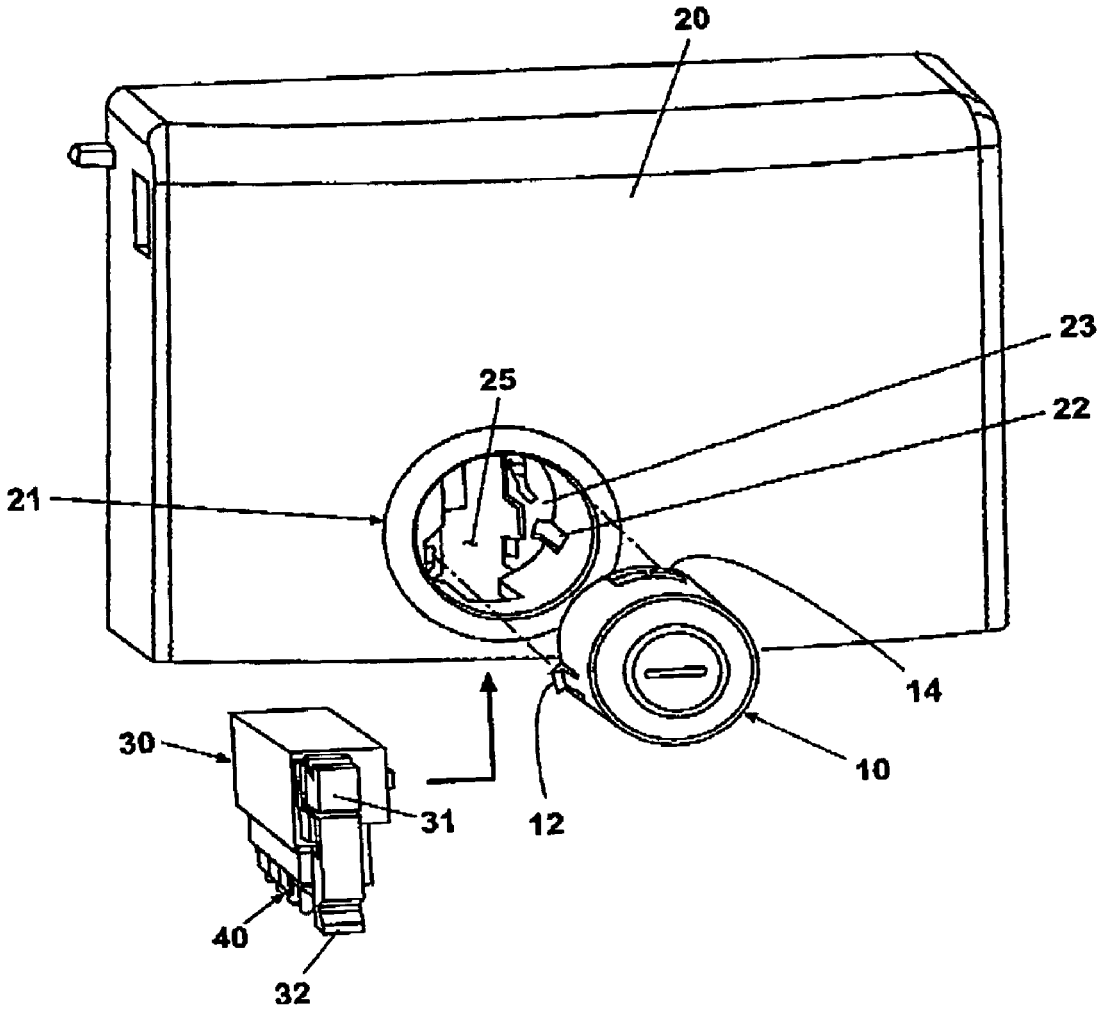
FIG. 3 the parts in an assembled arrangement as viewed from the front side of the control/display screen.
Figure 4:
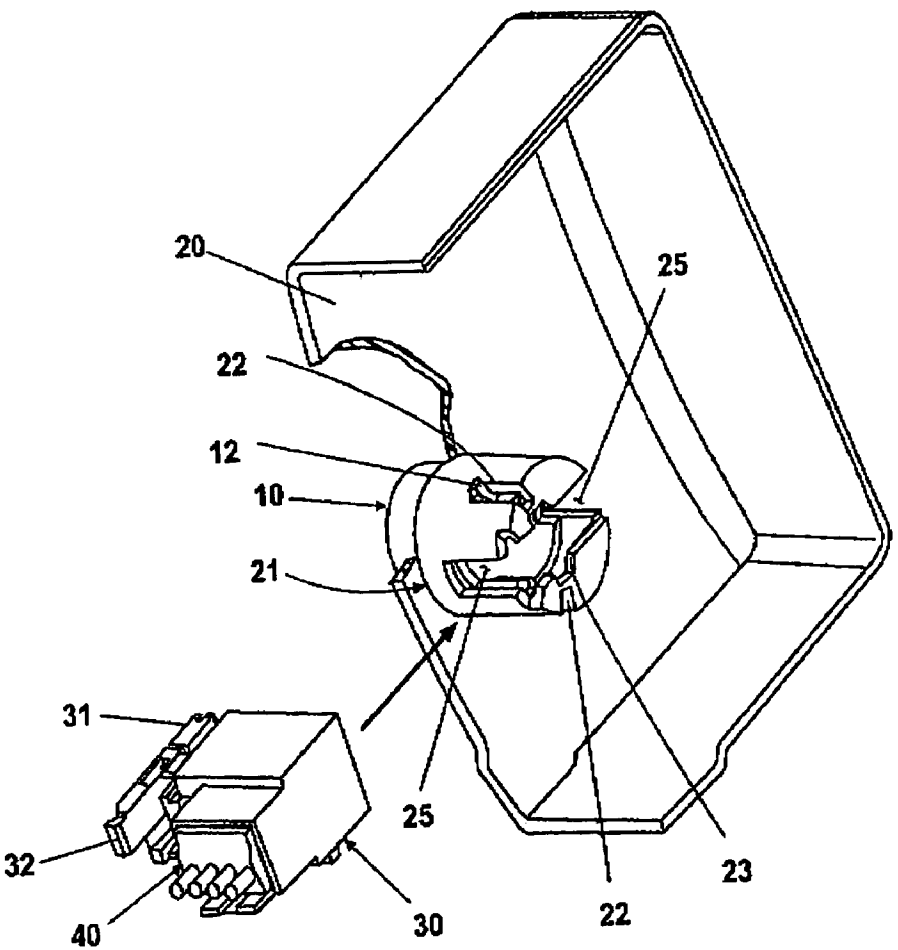
FIG. 4 the parts in an assembled arrangement as viewed from the rear side of the control/display screen.
Figure 5:
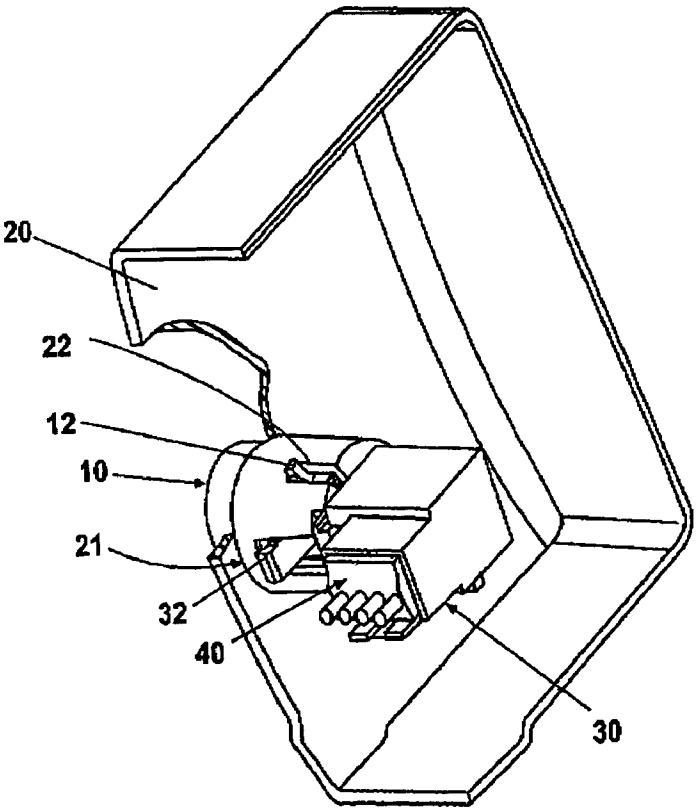
FIG. 5 the parts in an assembled arrangement as viewed from the rear side of the control/display screen with the activation element in a non-depressed state.
Figure 6:
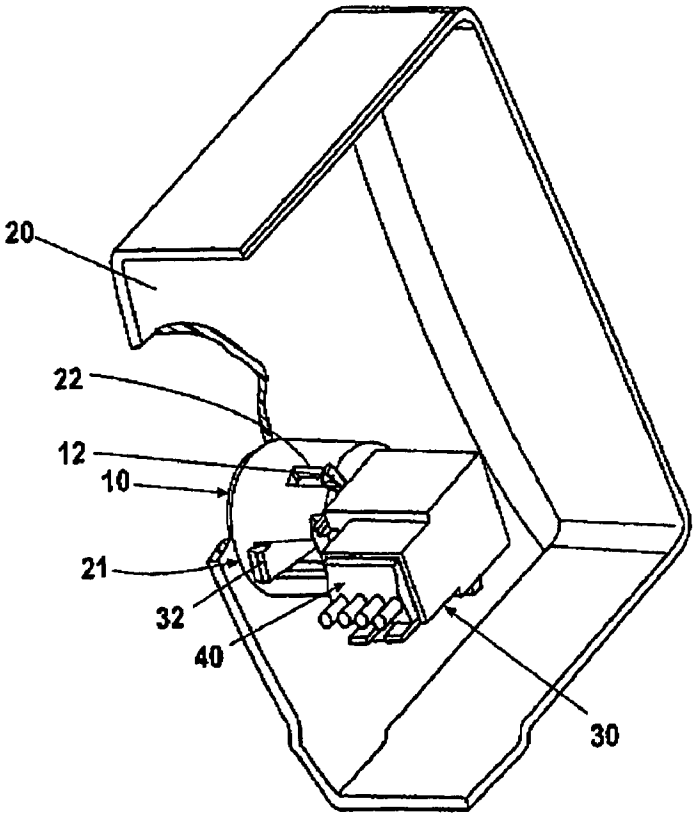
FIG. 6 the parts in an assembled arrangement as viewed from the rear side of the control/display screen with the activation element in a depressed state.

As can be seen in FIGS. 1 and 2, a pot-like receptacle 21 is formed onto the interior side of a box-like control/display screen 20 that forms a round opening in the front side of the control/display screen 20. The base of the receptacle 21 is partially exposed and forms a limit stop 23 for the cap-like activation element 10 which is insertable into the receptacle 21 and which has limited axial adjustability therein, that with exposed face 13 forms the counter stop element for the limit stop 23. Two opposing snap springs 11 are separated in the housing of the activation element 10 that extend to the face 13 and are axially aligned. If the activation element 10 is inserted into the receptacle 21, then the snap springs 11 snap into the snap notches 22 of the receptacle 21, which are dimensioned such that the snap flanges 12, which protrude from the perimeter of the activation element 10, are guided into the snap slots 22 and subsequently limit the adjustment path of the activation element 10 in the receptacle 21. In the housing of the activation element 10 a transverse notch forms a catch receptacle 14, while the receptacle 21 forms a transversely aligned receiving cavity 25, into which a switching component 30 equipped with an adjustable control component 31 can be inserted transverse to the adjustment direction of the activation element 10 and snapped in. Moreover, a catch 32 of the control component 31 is inserted into the catch receptacle 14 of the activation element 10 and connected with it such that the control component 31 takes on the adjustment movement of the activation element 10. The actuating forces transferred onto the control component 31 are not able to undo the snap connection between the receiving cavity 25 and the switch part 30 such that the parts maintain a defined position to each other. The switch part 30 may also comprise the contact bank of the electric switch. The switch part 30, however, can also be separated from the contact bank as switching component 40 and inserted into a receptacle 33 of the switch part 30, wherein the contact bank or the control component 31 of the switch part 30 defines the switching characteristics—monostable or bistable—of the electric switch. In other words, the receptacle 33 and the control component 31 are specific nieces of the switch part 30.

As can be explained easily using FIGS. 3–6, in the starting position the activation element 10 can protrude on the front side of the control/display screen 20 by the adjustment path length. When the activation element 10 is moved into the receptacle 21, it is flush with the front of the control/display screen 20 and the electric switch assumes the second switch position. Furthermore, after disengagement, the activation element 10 and the switch part 30 or switching component 40 can be reset to the starting position according to the formation of the switch part 30 with the control component 31 or the switching component 40. The switching component 40 or the switch part 30, however, can maintain the switch position into which it has been set until a second, subsequent activation of the activation element 10 releases the engaged switch position and both return with the activation element 10 to the starting position.

What is claimed is:

1. An electric switch with a cap-shaped activation element that is inserted and retained with limited axial adjustability in a pot-shaped receptacle formed on a switch panel and that is connected to a control component of a switch part that is set to two positions by means of the activation element, wherein two axially-aligned snap springs are separated on a perimeter of the activation element that protrude over a peripheral contour of the activation element with snap flanges, that the snap springs are adapted to be snapped into axially-aligned snap notches of the pot-shaped receptacle on a control/display screen and have limited axial adjustability, that the pot-shaped receptacle provides a receiving cavity for the switch part into which the switch part is introducible perpendicular to axial direction and localizable in the pot-shaped receptacle, that the receptacle of the control/display screen is at least partially closed and acts as a limit stop for the axial adjustment of the activation element in the pot-shaped receptacle, that an exposed face of the activation element constitutes a counter-stop and that when inserting the switch part into the receiving cavity, the control component of the switch part is introducible with a catch into a catch receptacle of the activation element and subsequently connectable with the activation element.

2. An electric switch according to claim 1, wherein the switch part is snapped into the receiving cavity of the pot-shaped receptacle and occupies a defined connect position.

3. An electric switch according to claim 2, wherein the snap notches of the pot-shaped receptacle define the axial adjustment range of the activation element in the pot-shaped receptacle and subsequently a feed path of the control component of the switch part, which is connected with the activation element.

4. An electric switch according to claim 3, wherein the switch part is designed as a monostable or bistable switching component.

5. An electric switch according to claim 4, further comprising a switch-part receptacle in the switch part for the switching component that when placed into the switch part is connectable with the control component of the same.

6. An electric switch according to claim 5, wherein switching components equipped with varying contact banks are adapted to be inserted into the switch-part receptacle arbitrarily.

7. An electric switch according to claim 6, wherein the activation element and the pot-shaped receptacle of the control/display screen are essentially round in shape.

8. An electric switch according to claim 7, wherein the activation element and the control/display screen with the pot-shaped receptacle are designed and produced as a one-piece plastic-injection mold.

* * * * *